US005628130A

United States Patent [19]

Desrochers

[11] Patent Number: 5,628,130

[45] Date of Patent: May 13, 1997

[54] TOOL FOR EXCAVATING BENEATH BURIED UTILITY LINES

[75] Inventor: Roland Desrochers, Calgary, Canada

[73] Assignee: RFJ Industries Ltd., Calgary, Canada

[21] Appl. No.: 574,937

[22] Filed: Dec. 19, 1995

[51] Int. Cl.[6] ..... E02F 03/40

[52] U.S. Cl. ..... 37/444; 37/446; 172/701.1; 172/810

[58] Field of Search ..... 37/403, 404, 405, 37/406, 407, 408, 409, 410, 444, 446; 172/701.1, 810; 414/723, 724, 912

[56] References Cited

U.S. PATENT DOCUMENTS

| | | | |
|---|---|---|---|
| 2,644,251 | 7/1953 | Smith | 37/404 |
| 2,652,640 | 9/1953 | Schield | 37/103 |
| 3,181,256 | 5/1965 | Discenza | 37/117.5 |
| 3,195,747 | 7/1965 | Kashergen | 37/444 X |
| 3,305,951 | 2/1967 | Nunn | 37/98 |
| 3,523,380 | 8/1970 | Bolyard | 37/141 |
| 3,942,271 | 3/1976 | George | 414/724 X |
| 4,009,529 | 3/1977 | Johnson | 37/404 |
| 4,085,530 | 4/1978 | Landry | 37/98 |
| 4,360,980 | 11/1982 | Jarvis | 414/724 X |
| 4,669,947 | 6/1987 | Frost | 414/912 X |
| 4,798,011 | 1/1989 | Sprinkle | 37/408 |
| 4,848,012 | 7/1989 | Zimmerman | 414/912 X |
| 4,905,386 | 3/1990 | Taylor | 37/195 |
| 4,986,010 | 1/1991 | Cartner | 37/108 R |
| 5,020,249 | 6/1991 | Matthews | 37/103 |
| 5,212,897 | 5/1993 | Jefferson | 37/403 |
| 5,253,449 | 10/1993 | Webb et al. | 37/468 X |
| 5,353,531 | 10/1994 | Doucette | 37/444 |
| 5,392,541 | 2/1995 | O'Riordan | 37/468 |
| 5,443,126 | 8/1995 | Skjaeveland | 172/265 X |
| 5,490,340 | 2/1996 | Muncy | 37/404 X |

*Primary Examiner*—Terry Lee Melius
*Assistant Examiner*—Victor Batson
*Attorney, Agent, or Firm*—David S. Thompson

[57] ABSTRACT

A tool for attachment to the end of the articulated arm of a backhoe or other power shovel is disclosed. The tool provides a forwardly directed blade; i.e. a blade directed away from the tractor unit of the power shovel. The blade is usable to excavate soil from under a buried pipeline, and allows an operator to see the blade while in use. The blade of the invention is substantially planar in structure, and is formed from a larger flat bottom plate welded to a smaller flat top plate. The tool additionally provides left and right ears, each ear having an upper and a lower pin hole for attachment to the end of the articulated arm. Each pin hole provides a reinforcing collar. Braces reinforce the connection between the blade and the ears.

6 Claims, 3 Drawing Sheets

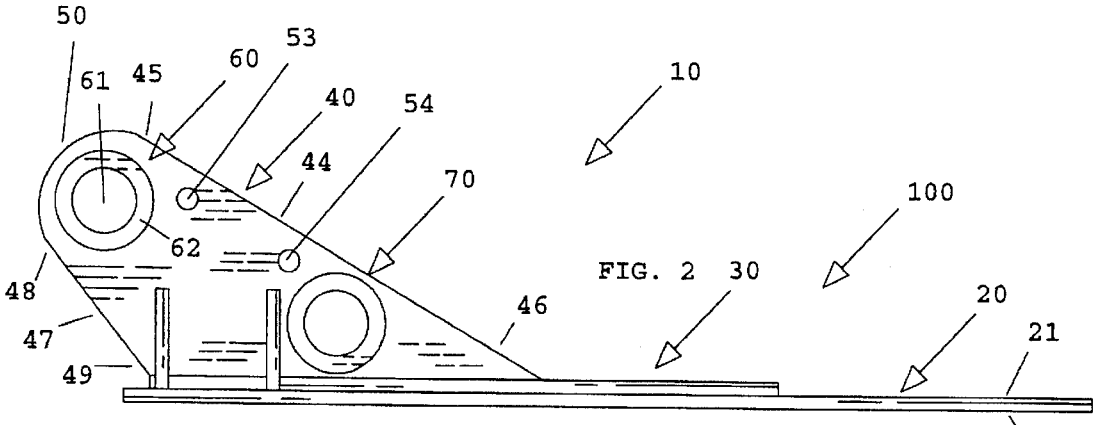
FIG. 2
FIG. 3
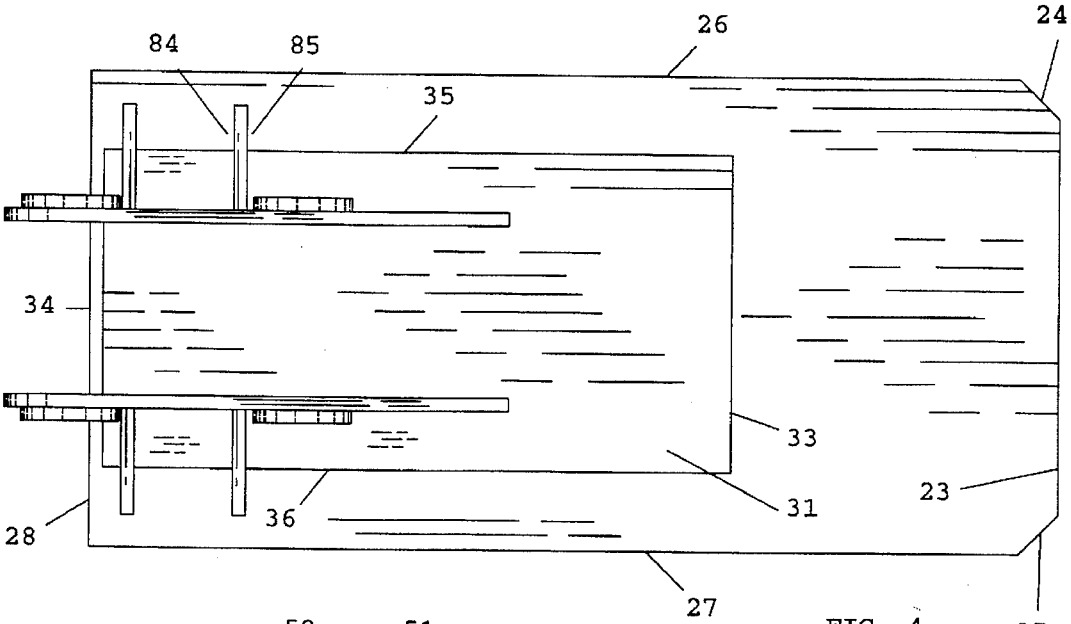
FIG. 4
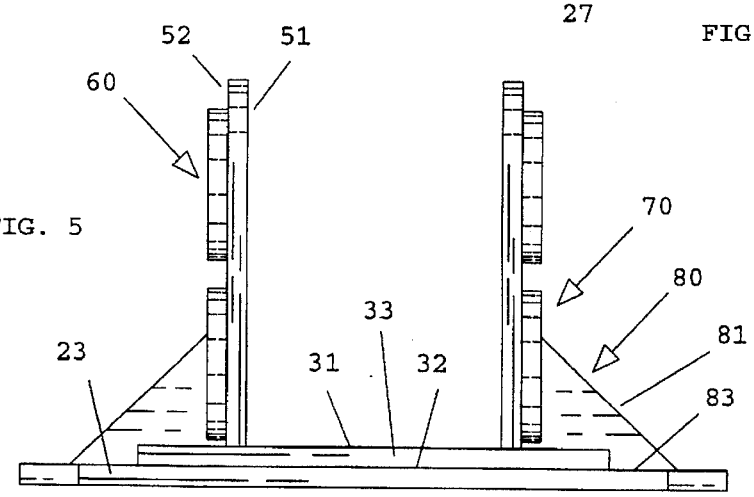
FIG. 5

TOOL FOR EXCAVATING BENEATH BURIED UTILITY LINES

CROSS-REFERENCES

There are no applications related to this application filed in this or any foreign country.

BACKGROUND

Excavation machinery such as "power shovels", "backhoes" and "ditchdiggers" are well known and widely used. A typical power shovel provides a tractor supporting an articulated arm carrying a "bucket", which typically provides a cutting edge having a plurality of teeth. Such machinery greatly lessens the time required to excavate large quantities of material. However, as will be shown, the structure of the tool supported by the articulated arm may lead an operator to severely damage buried utility lines, often with great resulting injury, damage and expense.

Frequently it is necessary to excavate both above and below a buried utility line, such as a gas or oil pipeline. This work may be required to make repairs in a first utility line, or to install an additional utility line that will cross under existing utility lines. Such excavation is usually quite hazardous, since errors by the machinery operator could result in considerable damage to the pipe being excavated.

Unfortunately, the operator of a typical backhoe or power shovel is frequently unable to see the exact location of the blade portion of the bucket carried by the end of the articulated arm. This is because the backhoe arm typically reaches out over the pipeline, and the open side of the bucket, with its lower edge blade or teeth, is hidden behind the pipeline as the operator removes material from beneath of the pipeline. The "prior art" figure illustrates this typical situation, where the pipeline blocks the operator's view of the bucket. Attempting to use the bucket on the same side of the pipe as the tractor unit of the backhoe would fail, since the open side and the cutting teeth of the bucket face the tractor. If effect, the design of the typical tool attached to the articulated arm of a backhoe is useful only for removing dirt that is between the tractor and the tool attached to the end of the arm. As a result, the operator would be unable to remove material located under the pipe unless the arm reaches over the pipe. Therefore in practice, the operator reaches over the pipe with the articulated arm, and relies on experience and guess-work to tell him where the bucket is in relation to the pipe.

It is therefore the case that there is an urgent need for an attachment tool that is suited for operation with all types of power shovels that allows the operator to clearly see both the attachment tool and the pipeline at the same time. The attachment tool must allow the operator to excavate on the near side of the pipe, i.e. on the same side of the pipe as the tractor unit is on. Such an attachment tool would speed work by allowing the operator to see what he was doing, because the pipe would not be located between the operator and the attachment tool, where the pipe would block the operator's view, as is the case in the prior art. Such an attachment tool would substantially reduce the risk of damage to the pipeline, of explosion, and of injury.

SUMMARY

The present invention is directed to an apparatus that satisfies the above needs. A novel tool for utilization with a power shovel of the type having a tractor unit having an articulated arm is provided. The tool attaches to the articulated arm and is operated in a manner that allows an operator to see the tool and entire arm during use, and to excavate material from beneath a utility line without having to move the tool into the blind-spot behind the utility line.

The tool of the present invention provides:

(a) A forwardly directed blade. The forwardly directed blade of the tool of the invention allows the machine operator to excavate material from beneath a utility line, with known types of excavation machinery, while keeping all parts of the tool on the same side of the utility line as the operator. The blade of a preferred version of the invention is planar in configuration and is a slightly elongate rectangle in shape, having a bottom plate and a smaller, reinforcing top plate. The cutting edge of the blade is directed forwardly, away from the tractor unit of the excavation machinery it is attached to, unlike the buckets typically used in excavation, which provide a cutting surface with teeth pointing toward the tractor. Because the blade is forwardly directed, the entire tool may therefore be seen during use.

(b) Connection means to attach the tool to known types of power shovels. In the preferred embodiment of the invention, the connection means includes left and right ears. Each ear is attached to the blade, and has a forward and a rearward pin hole. The ears are shaped, and the pin holes positioned, to allow convenient attachment to a known power shovel of any type, including a backhoe or larger shovel, having an articulated arm that is suited for excavation purposes. A collar frames each pin hole, and provides strength and reinforcement.

(c) Brace means to reinforce the connection between the forwardly directed blade and the connection means. In the preferred embodiment of the invention, the brace means includes a forward and a rearward brace on each ear. The braces add strength to the ears, and prevent bending. In the preferred embodiment, each brace is generally triangular, and has one side attached to an ear and one side attached to the blade.

It is therefore a primary advantage of the present invention to provide a novel attachment tool for an excavation machine, such as a power shovel or backhoe, having a forward-facing blade that will allow an operator to observe the movement of the blade when in use, and that will not require the operator to position the blade behind the utility line being excavated to remove material from beneath the utility line.

Another advantage of the present invention is to provide a novel attachment tool for an excavation machine that will allow excavation from under a utility line without the need for men to enter a trench and risk injury while excavating with hand tools.

Another advantage of the present invention is to provide a novel attachment tool for an excavation machine that will allow excavation from under a utility line in a more rapid and cost-effective manner.

A still further advantage of the present invention is to provide a novel attachment tool for an excavation machine that will greatly reduce the risk of piercing the pipe, and thereby reduce the risk of explosion, injury and environmental damage.

DRAWINGS

These and other features, aspects, and advantages of the present invention will become better understood with regard to the following description, appended claims, and accompanying drawings where:

FIG. 3 is side orthographic view of the tool of FIG. 2;

FIG. 4 is top orthographic view of the tool of FIG. 2;

FIG. 5 is front orthographic view of the tool of FIG. 2;

DESCRIPTION

Figure 7:
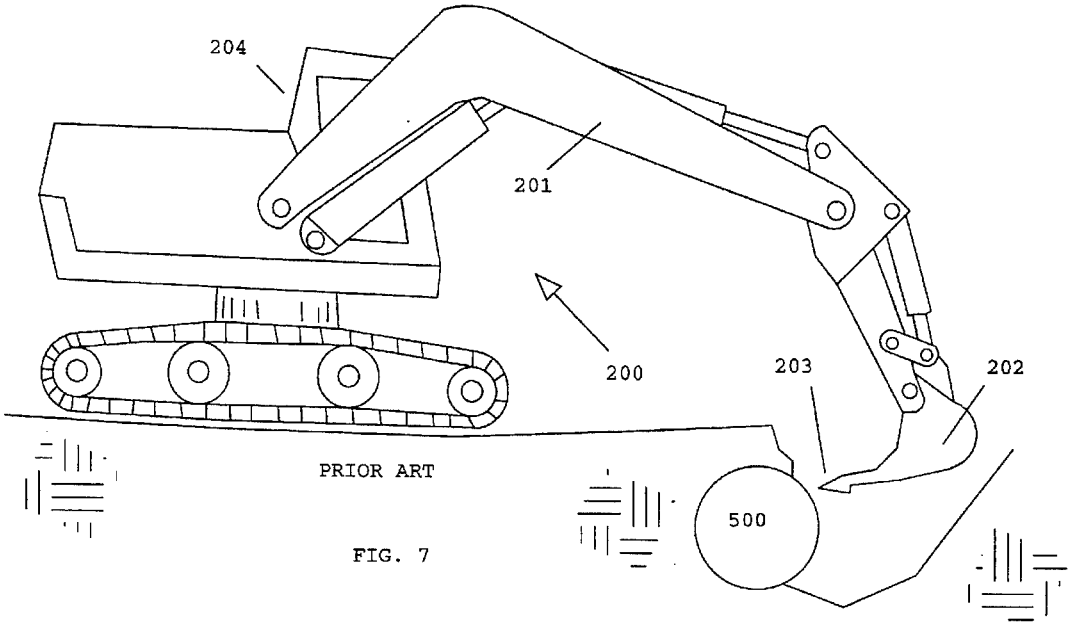
PRIOR ART FIG. 7
FIG. 7 is a view of a prior art bucket attached to a power shovel.

A tool 10 is disclosed for utilization with a power shovel or backhoe of the type used for excavation providing a tractor unit having an articulated arm. The tool attaches to the articulated arm and has a structure that allows a user to operate the tool in plain view during use, and to excavate material from beneath a utility line 500 without having to move the tool into the blind-spot behind the utility line. The tool provides a forwardly directed blade 100 having a bottom plate 20 that is reinforced by a top plate 30. Connecting means, including left and right ears 40 carried by the top plate 30, allow the tool 10 to be attached to a known type of power shovel 200. Each ear provides an upper pin hole 60 and a lower pin hole 70 to which facilitates rotation and movement of the tool by the power shovel. A forward brace 80 and a rearward brace 90 reinforce each ear.

Figure 1:
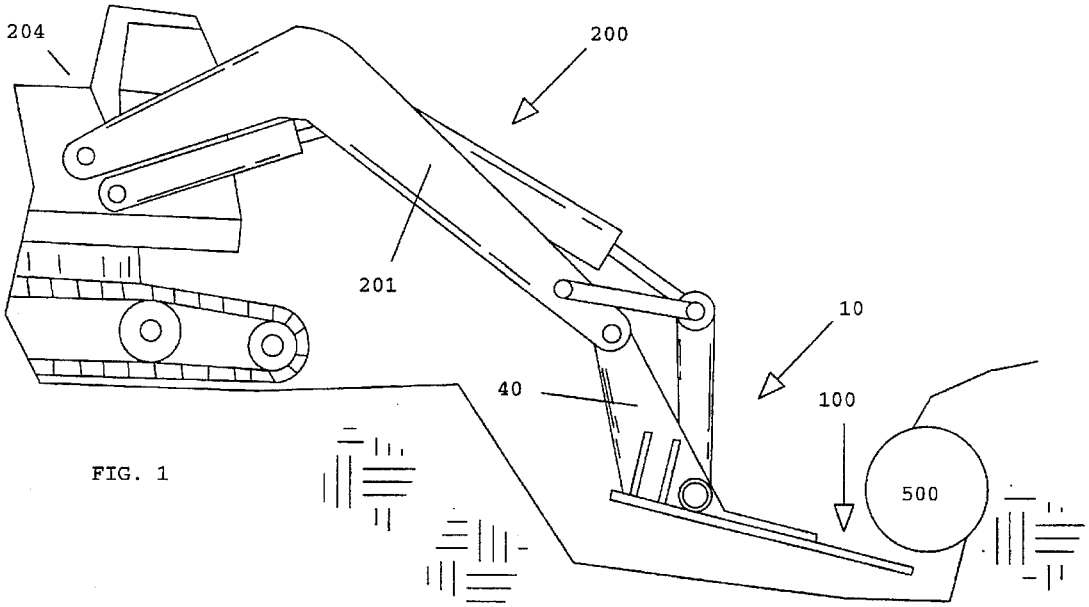
FIG. 1 is a view of the tool of FIG. 2, attached to a power shovel to illustrate its use.
Figure 2:
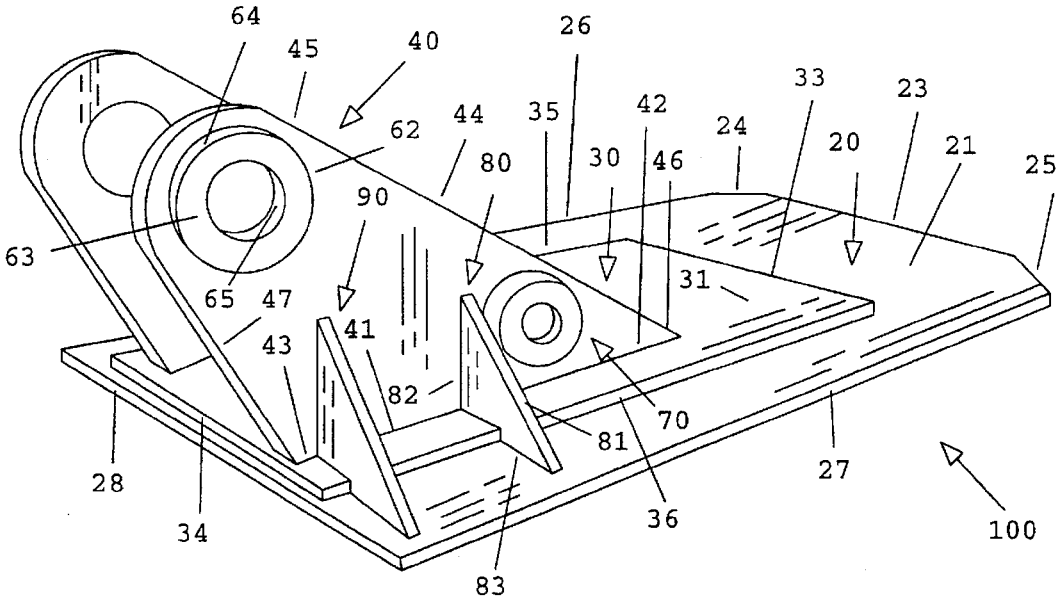
FIG. 2 is a perspective view of a version of the attachment tool of the invention.

Referring in particular to FIG. 2, a tool constructed in accordance with the principles of the invention is seen. The forwardly directed blade 100 is constructed of a top plate 30 and a bottom plate 20. As seen in FIG. 1, the blade is directed forwardly when in use. In contrast, the bucket attached to the arm 201 of the power shovel in the figure labeled "prior art" illustrates a bucket 202 having teeth 203 that are directed backwardly, at the tractor 204 of the power shovel 200.

The bottom plate 20 is formed of a planar sheet of steel plate, and has an upper surface 21 and a lower surface 22. As seen in FIGS. 3–5, a forward end edge 23 is somewhat shorter that the rearward end edge 28, because the front corners of the blade have been cut off, forming a left forward angled edge 24 and a right forward angled edge 25. Removal of the corners gives the blade 100 a blunt front end. A left side edge 26 and a similar right side edge 27 are roughly twice the length of the forward edge 23 and rearward edge 28.

In the preferred embodiment, the side edges 26, 27 of the bottom plate 20 are 71 inches long. The overall length of the bottom plate is 74 inches, and its thickness is 1 inch. The rearward end edge 28 is 36 inches in length, while the forward end edge 23 is approximately 30 inches long.

A top plate 30 is formed of a planar sheet of steel plate, and is attached, typically by welding, to the bottom plate 20, as seen in FIG. 2. The top plate reinforces the tool 10, substantially increasing its strength. The top plate is rectangular in shape, having a lower surface 32 that is welded to the bottom plate 20, and an upper surface 31, as seen in FIGS. 2 and 4. A forward end edge 33 and a rearward end edge 34 are typically equal in length. A left side edge 35 and a right side edge 36 are also generally equal in length, and typically approximately twice as long as end edges 33, 34.

In the preferred embodiment, the side edges 35, 36 of top plate 30 are 48 inches in length, while the end edges 33, 34 are 24 inches long. The top plate is 1 inch thick and is made of steel.

As seen in FIGS. 2–5, mirror image left and right ears 40, together with upper and lower pin holes 60, 70, provide the connecting means by which the tool 10 is attached to the arm of a power shovel. Each ear 40 provides a lower base edge 41 having a front portion 42 and a rear portion 43. The base edge 41 is attached, typically by welding, to the upper surface 31 of the top plate 30. A sloping front edge 44 having an upper portion 45 and a lower portion, 46 is adjacent to the front portion 42 of the base edge 41, as seen in FIG. 2. The sloping front edge 44 is typically at an approximately 45 degree angle to the top plate 30. A sloping rear edge 47 having an upper portion 48 and a lower portion 49 is adjacent to the rear portion 43 of the base edge 41, as seen in FIG. 2. The sloping rear edge 47 is typically at an approximately 60 degree angle to the top plate 30. A rounded top edge 50 is best seen in FIGS. 2 and 3. The top edge is adjacent to the upper portion 45 of the sloping front edge 44 and to the upper portion 48 of the sloping rear edge 47. As seen in FIG. 5, an inner surface 51 is directed to the arm 201, and an outer surface 52 is oppositely directed.

In the preferred embodiment, the left and right ears are constructed of 1 inch thick steel plate. The base edge 41 is approximately 32 inches in length. The front sloping edge 44 is approximately 38 inches in length. The rear sloping edge 47 is approximately 14 inches in length. The outside circumference of each ear is approximately 94 inches.

As seen in FIG. 3, left and right ears each provide a similar upper pin hole 60 and a lower pin hole 70, differing primarily in location only. The pin holes allow the tool 10 to be attached to the arm of a power shovel by known and standardized bolts. An open pin hole passageway 61 goes through the inner and outer surfaces 51, 52 of ear 40. A collar 62, welded to the ear 40, provides an annular end surface 63, outside cylindrical surface 64, and inside cylindrical surface 65. The function of the collar 62 is to reinforce the pin hole and to reduce stress on any pin inserted into the pin hole by providing a larger inside cylindrical surface 65 in contact with the pin.

In the preferred embodiment, the distance from the center of the upper pin hole 60 to the center of the lower pin hole 70 is 21 inches. Each pin hole is 3.5 inches in diameter. The radial measurement of the annular end surface 63 of each collar 62 is 2 inches. In the preferred embodiment, each pin hole collar provides a unitary structure that includes a short, 1 inch thick pipe that is inserted into open pin hole passageway 61. The pipe has a 1 inch flange that is attached to the outer surface 52 of the ear 40. Therefore, prior to installation of the collar, the two holes in each ear 40 are 5.5 inches in diameter. The collar reduces the diameter of the opening to 3.5 inches.

Optionally, each ear 40 may provide an upper safety bolt hole 53 and a lower safety bolt hole 54. The safety bolt holes provide a means to attach safety bolts which are a back-up means of connecting the blade 100 to the arm 201 of a power shovel.

As seen in FIGS. 2–5, a front brace 80 and a similar rear brace 90 hold the forwardly directed blade 100 and the ears 40 in a rigid relationship. Each brace is constructed of steel and is planar in configuration. Each brace provides a sloping outside edge 81 adjacent to a horizontal bottom edge 83 and a vertical edge 82. The bottom edge 83 is welded to the top plate 30 and to the bottom plate 20. The bottom edge 83 may be notched, as seen in FIG. 5, so that it fits precisely against the top and bottom plates. The vertical edge 82 is welded to the ear 40. As seen in FIG. 4, each brace 80, 90 has a forward surface 84 and a rearward surface 85.

In the preferred embodiment, all four braces are constructed of one-half inch thick sheet steel, and have an 8 inch bottom edge, a 6.5 inch vertical edge, and an 11 inch sloping outside edge. The distance between the pair of braces on each side of the tool is 9.5 inches.

Figure 6:
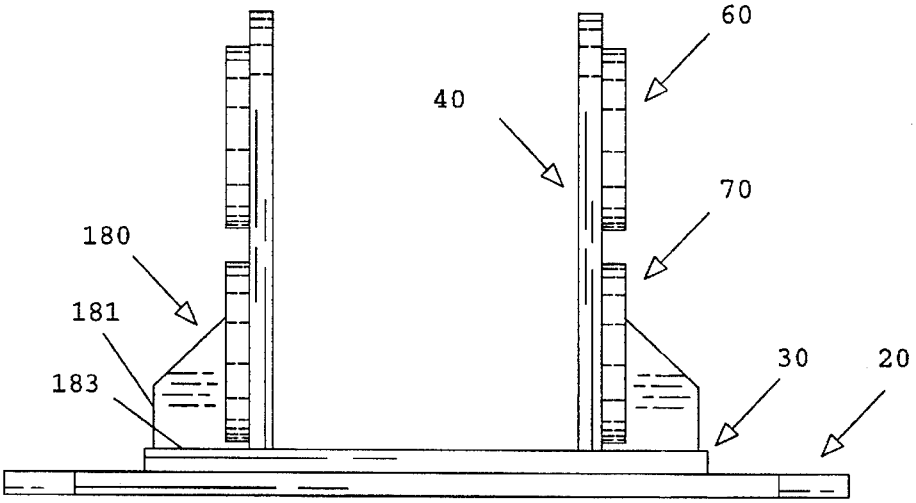
FIG. 6 is a front orthographic view of a second species of the the attachment tool of the invention, having a modified form of brace structure.

A second species brace 180 is seen in FIG. 6. This species is similar to braces 80, 90, but provides a vertical outside edge 181 and bottom edge 183 is attached only to top plate 30, and is not attached to bottom plate 20.

To use the tool 10 of the invention, an operator would first use conventional means to dig a trench parallel and adjacent to a buried utility pipeline. Frequently, the operator would first dig such trenches on both sides of the pipeline. To excavate material from beneath the pipeline, the operator would then attach the tool 10 of the invention to a power shovel. As seen in FIG. 1, the forwardly directed blade 100 is inserted into the ground beneath the pipeline. Importantly, the operator, tractor 204, arm 201 and attached tool 10 all remain on one side of the pipeline. In this manner, the operator is able to see the forwardly directed blade 100 at all times. After insertion, the blade may be rotated slightly, so that the forward end edge 23 of the bottom plate 20 is lowered, and the rearward end edge 28 raised. The blade is then withdrawn, causing material to be removed from underneath the pipeline. Where a trench has been dug on both sides of a pipeline, the tool 10 may also push material from underneath the pipeline to the trench on the opposite side of the pipeline. These actions are repeated, as necessary, until the area under the pipeline is sufficiently excavated. If needed, the material excavated by the tool 100 may be removed from the trench by conventional excavating machinery.

The previously described versions of the present invention have many advantages, including that of having a forward-facing blade that will allow an operator to observe the movement of the blade, and what will not require the operator to position the blade in the blind-spot behind the utility line being excavated to remove material from beneath the utility line.

Another advantage of the present invention is to provide a novel attachment tool for an excavation machine that will allow excavation from under a utility line without the need for men to enter the trench and risk injury while excavating with hand tools.

Another advantage of the present invention is to provide a novel attachment tool for an excavation machine that will allow excavation from under a utility line in a more rapid and cost-effective manner.

A still further advantage of the present invention is to provide a novel attachment tool for an excavation machine that will greatly reduce the risk of piercing the pipe, and thereby reduce the risk of explosion, injury and environmental damage.

Although the present invention has been described in considerable detail and with reference to certain preferred versions, other versions are possible. For example, the exact dimensions of the components of the tool 10 are somewhat variable, as long as the teachings of the invention are followed. Also, while the use of a top plate and a bottom plate to form the blade is preferred, a blade constructed of a single plate might in some cases be substituted. Moreover, while two braces per ear are preferred, a greater or lesser number might be substituted. Therefore, the spirit and scope of the appended claims should not be limited to the description of the preferred versions disclosed here.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A tool for attachment directly to an articulated arm of a power shovel, said tool comprising:

(a) a substantially planar forwardly directed blade; and (b) planar connection means, attached in a perpendicular manner to the blade, for connection to the articulated arm of the power shovel, the planar connection means comprising:

(a) parallel planar mirror image left and right ears, each ear having an upper pin hole and a lower pin hole, each ear attached at right angles to the forwardly directed blade; and (c) brace means, attached in a perpendicular manner to the forwardly directed blade and attached in a perpendicular manner to the connection means, for strengthening the connection between the forwardly directed blade and the connection means.

2. The tool of claim 1, in which the brace means comprises:

(a) at least one left brace, having a bottom edge attached at right angles to the forwardly directed blade and having a vertical edge attached at right angles to the left ear; and (b) at least one right brace, having a bottom edge attached at right angles to the forwardly directed blade and having a vertical edge attached at right angles to the right ear.

3. The tool of claim 2, wherein the forwardly directed blade comprises a top plate connected to a bottom plate.

4. The tool of claim 2, wherein each ear has an upper and a lower safety bolt hole.

5. A tool for utilization with a power shovel of the type having an articulated arm, said tool comprising:

(a) a forwardly directed blade, comprising:

(a) a bottom plate, comprising:

(a) an upper surface;

(b) a forward end edge, adjacent to the upper surface;

(c) a lower surface, adjacent to the forward end edge;

(d) left and right forward angled edges, adjacent to the forward end edge;

(e) a left side edge, adjacent to the left forward angled edge;

(f) a right side edge, adjacent to the right forward angled edge; and (g) rearward end edge, adjacent to the left and right side edges;

(b) a top plate comprising:

(a) a lower surface, welded to the upper surface of the bottom plate;

(b) a forward end edge, adjacent to the lower surface;

(c) an upper surface, adjacent to the forward end edge;

(d) left and right side edges, adjacent to the upper surface; and (e) rearward end edge, adjacent to the upper surface;

(b) connection means, attached to the upper surface of the top plate, for facilitating connection to the articulated arm of the power shovel, comprising:

(a) mirror image left and right ears, each ear having an inner surface directed toward the articulated arm and an oppositely directed outer surface, each ear also having an upper pin hole and a lower pin hole, each ear further comprising:

(a) a base edge, having a front portion and a rear portion, the base edge attached to the upper surface of the top plate;

(b) a sloping front edge, having an upper portion and a lower portion, adjacent to the front portion of the base edge;

(c) a sloping rear edge, having an upper portion and a lower portion, adjacent to the rear portion of the base edge;

(d) a rounded top edge, adjacent to the upper portion of the sloping front edge and adjacent to the upper portion of the sloping rear edge;

(e) a collar, framing the upper pin hole passageway, the collar having an annular end surface, a cylindrical inside surface and a cylindrical outside surface, attached to the outer surface of the ear; and (f) a collar, framing the lower pin hole passageway, the collar having an annular end surface, a cylindrical inside surface and a cylindrical outside surface, attached to the outer surface of the ear; and (c) brace means, attached to the upper surface of the top plate and to the outer surface of each ear, for strengthening the connection between the forwardly directed blade and the connection means, comprising:

(a) a left front brace, having a bottom edge welded to the upper surface of the top plate and having a vertical edge welded to the outer surface of the left ear;

(b) a left rear brace, having a bottom edge welded to the upper surface of the top plate and having a vertical edge welded to the outer surface of the left ear;

(c) a right front brace, having a bottom edge welded to the upper surface of the top plate and having a vertical edge welded to the outer surface of the right ear; and (d) a right rear brace, having a bottom edge welded to the upper surface of the top plate and having a vertical edge welded to the outer surface of the right ear.

6. The tool of claim 5 wherein each ear has an upper and a lower safety bolt hole.

* * * * *